US007011738B2

(12) United States Patent
Bergman et al.

(10) Patent No.: US 7,011,738 B2
(45) Date of Patent: Mar. 14, 2006

(54) ACTIVATION OF A CATHODE

(75) Inventors: Lars-Erik Bergman, Ljungaverk (SE); Erik Zimmerman, Ljungaverk (SE); Tomas Widenfalk, Knivsta (SE); Bernd Busse, Darmstadt (DE)

(73) Assignee: Akzo Nobel N.V., (NL)

( * ) Notice: Subject to any disclaimer, the term of this patent is extended or adjusted under 35 U.S.C. 154(b) by 527 days.

(21) Appl. No.: 10/332,048

(22) PCT Filed: Jun. 25, 2001

(86) PCT No.: PCT/SE01/01447

§ 371 (c)(1),
(2), (4) Date: Feb. 25, 2003

(87) PCT Pub. No.: WO02/02847

PCT Pub. Date: Jan. 10, 2002

(65) Prior Publication Data

US 2003/0159923 A1 Aug. 28, 2003

Related U.S. Application Data

(60) Provisional application No. 60/216,491, filed on Jul. 6, 2000.

(30) Foreign Application Priority Data

Jul. 6, 2000 (EP) ..... 00850124

(51) Int. Cl.
*C25D 5/48* (2006.01)

(52) U.S. Cl. ..... 205/220; 205/205; 205/210; 205/215; 205/216; 205/217; 205/218; 205/264; 205/263; 205/265; 205/266

(58) Field of Classification Search ..... 205/205, 205/210, 215, 216, 217, 218, 220, 263, 264, 205/265, 266
See application file for complete search history.

(56) References Cited

U.S. PATENT DOCUMENTS

| | | | | |
|---|---|---|---|---|
| 4,446,245 | A * | 5/1984 | Hinden | 502/101 |
| 4,575,467 | A | 3/1986 | Sirinyan et al. | |
| 5,035,789 | A | 7/1991 | Beaver | 204/290 R |
| 5,164,062 | A | 11/1992 | Byrd | 204/290 R |
| 5,476,688 | A | 12/1995 | Ostolski | 427/437 |
| 5,779,876 | A * | 7/1998 | Traini et al. | 204/267 |
| 5,882,723 | A * | 3/1999 | Tsou | 427/125 |
| 6,572,758 | B1 * | 6/2003 | Zolotarsky et al. | 205/503 |
| 6,802,948 | B1 * | 10/2004 | Hardee et al. | 204/290.14 |

FOREIGN PATENT DOCUMENTS

GB 2074190 10/1981

* cited by examiner

*Primary Examiner*—Bruce F. Bell
(74) *Attorney, Agent, or Firm*—White, Redway & Brown LLP

(57) ABSTRACT

The present invention relates to a method for activation of a cathode comprising at least a cathode substrate wherein the cathode is cleaned by means of an acid, the cleaned cathode is coated with at least one electrocatalytic coating solution, drying the coated cathode until it is at least substantially dry, and thereafter contacting the cathode with a solvent redissolving precipitated electrocatalytic salts or acids formed on the cathode, originating from the electrocatalytic solution, to form dissolved electrocatalytic metal ions on the cathode surface, so that said electrocatalytic metal ions can precipitate as metals on the cathode. The invention also comprises a cathode obtainable by the method and the use of an activated cathode in an electrolytic cell for producing chlorine and alkali hydroxide.

14 Claims, No Drawings

ACTIVATION OF A CATHODE

This application claims the benefit of Provisional App. No. 60/216,491, file Jul. 6, 2000.

The present invention relates to a method for activating a cathode suitable for activation on site at a production plant. The invention also relates to the use of the activated cathode in an electrolytic cell producing chlorine and alkali metal hydroxide.

BACKGROUND OF THE INVENTION

Electrodes are commonly, when in operation, immersed in an electrolyte in an electrolytic cell where chemical products are produced by way of oxidation and reduction reactions of reactants present in the electrolyte. The reduction reactions take place at the cathode where reduction products are obtained. The oxidation reactions take place at the anode where oxidation products are obtained.

Over time, the electrodes will become exhausted and deactivated due to various deactivation processes taking place while the electrolytic cells are in operation. In most electrolytic processes, the electric energy is the most expensive "raw material" in the electrolytic reactions.

In the chlorine and alkali metal hydroxide production, it has been found that the cathodes are liable to progressive deactivation over time. The cathodes are subjected to deposition and precipitation of materials present in the electrolyte and to other deteriorating processes deactivating the cathode. The decrease in activity leads to a higher power consumption due to an increased overvoltage.

It is thus a big concern in electrolysis processes to provide active cathodes throughout the whole electrolysis cycle.

Earlier attempts to solve this problem have involved transportation of the deactivated cathodes to the electrode manufacturer for reactivation. However, the transportation of cathodes is a very expensive and time-consuming alternative to carry out. Another approach of providing active cathodes has involved replacement of the exhausted cathodes with new ones.

U.S. Pat. No. 5,164,062 describes a method for preparing a new cathode comprising coating a cathode substrate of e.g. Ni with palladium and another electrocatalytic metal. The pH of the coating solution may be adjusted by an organic acid, e.g. acetic acid, oxalic acid and formic acid, or inorganic acids to maintain the pH below 2.8. However, the activation by this method is not always satisfactorily increased. Furthermore, a portion of the active coating solution is wasted in the method described above, because some of the acidic electrocatalytic coating solution is rinsed away from the cathode substrate in order to avoid corrosion of the cathode. The rinsing solution that has taken up remaining electrocatalytic material must then be decontaminated from substrate ions, e.g. nickel or other contaminating ions, which also are present on the cathode before the electrocatalytic material can be reused as coating material in an electrocatalytic solution again. Such decontamination procedure may involve several cleaning steps before the electrocatalytic material has been satisfactorily cleaned.

The present invention intends to solve the above problems.

THE INVENTION

The present invention relates to a method of activating a cathode suitable for the production of e.g. chlorine and alkali metal hydroxide. The term "activate" or "activation" etc. as used herein encompass both activation of a new electrode, which is to be prepared, and activation of an electrode, which has already been in operation in an electrolytic cell and which may have lost at least some of its initial activity.

It has been surprisingly found that the activation of a cathode comprising at least a cathode substrate, which may have some remains of an electrocatalytic coating on the substrate, can easily can be performed on site at the production site. The method comprises at least the following steps:

- cleaning the cathode by means of an acid
- coating the cleaned cathode with at least one electrocatalytic coating solution
- drying the coated cathode until it is at least substantially dry, and thereafter contacting the cathode with a solvent redissolving precipitated electrocatalytic salts or acids formed on the cathode, originating from the electrocatalytic coating solution, to form dissolved electrocatalytic metal ions on the cathode surface, so that the electrocatalytic metal ions can precipitate as metals on the cathode.

The solvent must be able to redissolve any possible precipitated electrocatalytic salts or acids on the cathode originating from the electrocatalytic coating solution. The solvent may contain a small amount of electrocatalytic metals dissolved therein, which may originate from a rinsing solution containing remains of an electrocatalytic solution. The contacting of the solvent with the cathode is suitably performed by spraying or in any other way putting solvent on the cathode in a suitable amount.

By the term "substantially dry" is meant a coated cathode which contains only a small quantity of solution on its surface such that the solution does not substantially flow away from the cathode. Suitably, such quantity ranges from about 0 to about 10 ml/m$^2$, preferably from about 0 to about 5 ml/m$^2$ solution.

The cathode comprises a substrate of e.g. nickel, cobalt, copper, iron, steel, particularly stainless steel, or alloys or mixtures thereof, preferably nickel. The cathode may also comprise remains of an electrocatalytic coating deposited on the substrate, and/or contaminants from an electrolytical process.

Used cathodes are preferably disassembled from the cells before activation.

According to one embodiment, the cathode is welded to a pan. The used cathode pan structure, i.e. the cathode and the pan, is preferably disassembled and removed from the cell before activation. For simplicity, the term "cathode", where otherwise not stated, will henceforth also signify the cathode pan structure.

The cathode is cleaned with a cleaning solution comprising at least one acid. The pH of the cleaning solution is suitably adjusted by addition of an inorganic acid, e.g. HCl, $H_2SO_4$, $HNO_3$, or an organic acid, e.g. oxalic acid or other organic acids, or mixtures thereof, suitably to a pH from about −1 to about 6, preferably from about −1 to about 3. The acid reacts with the cathode substrate and is also believed to react with precipitated substances on the substrate and the electrocatalytic coating. The cleaning time is not critical and may range from about a few minutes to about 30 minutes or more. The temperature during the cleaning is not critical and may be at e.g. room temperature, suitably the temperature ranges from about 0 to about 100° C., preferably from about 0 to about 35° C.

According to one preferred embodiment of the invention, also a reducing agent is comprised in the cleaning solution which is believed to prevent corrosion of the cathode and facilitate removal of deactivating precipitates on remaining electrocatalytic coating. The reducing agent is also believed to stabilise activated areas of the cathode. The reducing agent may be present in the cleaning solution at a concentration of from about 0.5 to about 50 wt %, preferably from about 0.5 to about 10 wt %. The reducing agent is suitably selected from alcohols such as isopropyl alcohol or n-pentanol, HCl, $H_3PO_2$, $H_3PO_3$, $N_2H_4$, $NH_2OH$, $NH_3$, $Na_2S$, $NaBH_4$, sodium hypophosphite ($NaH_2PO_2$), dimethylamine borane $(CH_3)_2NHBH_3$, or mixtures thereof. Preferred reducing agents are selected from HCl, $H_3PO_2$, $H_3PO_3$, $N_2H_4$, $NH_2OH$, and $NH_3$, and most preferably from HCl.

After the cleaning; the cathode is suitably rinsed and dried. The cathode is then contacted with at least one electrocatalytic coating solution, comprising an electrocatalytic metal and preferably a complexing agent.

According to one embodiment of the invention, several electrocatalytic coating solutions, e.g. two or more coating solutions, may be contacted with the cathode. The coating solutions are suitably contacted with the cathode one after the other, preferably when the previously applied coating solution has dried on the surface of the cathode.

The electrocatalytic coating solution or solutions are suitably applied by means of painting, rolling or any other plausible method suitable for on-site coating. The electrocatalytic coating solution suitably comprises one or several noble metals in the form of salts or acids or the like, selected from the platinum group, e.g. Ru, Rh, Os, Ir, Pd, Pt, Au, Ag, or alloys or mixtures thereof. The noble metals can suitably be present in the coating solution at a concentration from about 25 to about 200, preferably from about 50 to about 150 g metal/litre coating solution. The electrocatalytic metals are suitably derived from salts or acids of e.g. platinum metals such as hexa chloro platinum acid, platinum metal alcoxi complexing materials, chlorides or the like. The coating time of the cathode is not critical and may be for about one hour or more. The temperature of the coating solution suitably is room temperature, but may range from about 0 to about 100° C. The coating procedure is suitably carried out within the same temperature range, i.e. 0–100° C., preferably between 0 and 35° C. Also a complexing agent may be added to the coating solution preferably in a concentration of from about 100 to about 500, and most preferably from about 350 to about 450 g/litre coating solution. The optionally added complexing agent facilitates the oxidation and reduction reactions taking place when the coating solution is contacted with the substrate. The substrate metal of the cathode is spontaneously oxidised to its corresponding ionic form whereas the electrocatalytic metal or metals in the coating solution is reduced from its ionic form to its metallic form thereby forming an electrocatalytic coating on the substrate. It has been found that the complexing agent supports the reduction/oxidation reaction taking place so as to improve the precipitation reaction and the adherence of the electrocatalytic metal to the substrate. Suitable complexing agents comprise hypophosphorous acid, sulphurous acid, nitrous acid, alcohols such as glycol, glycerine, acetate, propionate, succinate, hydroxyacetate, α-hydroxypropionate, aminoacetate, ethylenediamine, β-aminopropionate, malonate, pyrophosphate, malate, citrate, ammonium salts, EDTA, or mixtures thereof.

The coated cathode is then allowed to dry so it becomes at least substantially dried, suitably from about 0 to about 10 ml/$M^2$, preferably from about 0 to about 5 ml/$m^2$. Preferably, the coated cathode is completely dried before it is contacted with the solvent. The dried cathode is then contacted with a solvent suitably comprising a reducing agent. It has been surprisingly found that the contacting of the solvent with the cathode results in a lower overpotential, often 10–30 mV lower or more, than a cathode not treated in this manner. The solvent may comprise water, suitably in combination with HCl, $H_3PO_2$, $H_3PO_3$, $H_2O_2$, $N_2H_4$, $NH_2OH$, $NH_3$, $Na_2S$, $Na_2SO_3$,$K_2SO_3$, a alcohol, n-pentanol, or mixtures thereof. The lower overpotential is considered to be principally due to a higher deposit level of electrocatalytic metals on the activated cathode. The concentration of a possible reducing agent in the solvent suitably ranges from about 10 to about 70 wt %, preferably from about 40 to about 50 wt %. The temperature during the contacting of the cathode with a solvent suitably ranges from about 8 to about 60° C., preferably from about 15 to about 35° C. The reaction time during which electrocatalytic metals can precipitate as metals on the cathode suitably is from about 1 to about 60 minutes or until the electrode is completely dried. Suitably, solvent can thereafter again be deposited on the cathode to repeat the precipitation procedure of electrocatalytic metals in case such remains exist on the cathode in the form of salts or acids. Suitably, an amount from about 10 to about 100 ml solvent/$m^2$ cathode area is contacted with the cathode, preferably from about 50 to about 100 ml solvent/$m^2$.

The activated cathode is then preferably rinsed by a rinsing solution such as water to avoid corrosion, preferably with a basic solution such as NaOH after that the solvent on the cathode has substantially dried. Preferably, the basic rinsing solution has a concentration of e.g. NaOH from about 0.0001 to about 50 wt %, and most preferably from about 0.0001 to about 20 wt %.

The activated cathodes are usually run in the electrolytic cells until their activity is found to be too low, i.e. at an uneconomically low level. This crucial extent of deactivation can be optimised by a person skilled in the art by estimating the electric energy consumed and the activation costs. When the reactivation is to be initiated, the used cathodes are preferably disassembled and removed from their cells. Suitably, the reactivation can be performed in connection with replacement of the membranes arranged in the electrolytic cell.

The present invention also relates to a cathode obtainable by the method as described above.

The invention further concerns the use of an activated cathode in an electrolytic cell for producing chlorine and alkali metal hydroxide.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it.

EXAMPLE 1

A cleaning solution was prepared from concentrated hydrochloric acid (37 wt %) to yield a final concentration of 20 wt % hydrochloric acid. The cathode to be activated was contacted with the cleaning solution by means of painting. 50 ml cleaning solution/$m^2$ geometric cathode area was applied. The solution was then allowed to react during 10 minutes at room temperature (25° C.). The cathode was thereafter rinsed thoroughly with deionised water. Meanwhile, a coating solution of $RhCl_3$ was prepared by dissolving the rhodium salt in a 20 wt % hydrochloric acid solution, resulting in a final rhodium concentration of 50 g Rh metal/litre coating solution. Also a coating solution of $RuCl_3$ was prepared by dissolving the Ru salt in another 20 wt % hydrochloric acid solution resulting in a concentration of 50 g Ru metal/litre coating solution. The rinsed cathode was allowed to dry in room temperature, whereafter the Rh coating solution was applied thereto in an amount of 50 ml/m$^2$ geometric cathode area by means of painting. The cathode was then allowed to dry for 1 hour. The Ru coating solution was then applied to the Rh coated cathode in an amount of 50 ml/m$^2$ geometric cathode area. The cathode was then dried whereafter an aqueous solution of 50 wt % $H_3PO_2$ was painted on the cathode. Thereafter, the cathode was allowed to dry whereupon it was rinsed with water. The cathode obtained showed satisfactory activation.

EXAMPLE 2

Two deactivated nickel-based cathode samples P1 and P2 were cleaned by means of painting with a 20 wt % hydrochloric acid solution for 5 minutes. The cathode samples were thereafter rinsed with water and thereafter dried. The two samples were both coated with a 40 ml $RhCl_3$ coating solution having a rhodium content of 150 g/litre/m$^2$. The coated samples were then allowed to dry for 1 hour. Unreacted rhodium precipitated during the drying stage and formed rhodium chloride salt on the cathode substrate. The P1 sample was gently rinsed with a caustic solution having a pH of 10, whereupon unreacted precipitated rhodium metal salt ($RhCl_3$) and nickel chloride were rinsed off the cathode sample. The remaining amount of rhodium on the P1 sample only amounted to a small portion of the initially precipitated rhodium content. This was judged from the rhodium colour the rinsing solution got since the metal was partially washed off. The P2 cathode sample was gently sprayed with a 20 wt % hydrochloric acid after the $RhCl_3$ solution had dried on the sample, whereupon precipitated $RhCl_3$ was redissolved. Subsequent precipitation of metallic rhodium could then take place on the P2 sample. The addition of hydrochloric acid to the P2 cathode was repeated once after that the P2 cathode had dried. 15 minutes after the second addition of hydrochloric acid, i.e. after that the cathode was substantially dry, the cathode was rinsed with caustic solution in the same manner as the P1 sample. No colour shift could be observed in the rinsing solution due to rinsed off rhodium. It was thus shown that a much higher amount of rhodium had adhered to the P2 sample than to the P1 sample as a result of adding the solvent to the coated and dried sample. Electrolytic trials performed involving use of the activated cathodes showed that the cell voltage was 230 mV lower for the P2 cathode than for the P1 cathode when the used electrolytic cell was operated at a current density of 4.7 kA/m$^2$.

The invention claimed is:

1. A method for activation of a cathode comprising at least a cathode substrate, said method comprising the steps of:

(a) cleaning said cathode by means of an acid;

(b) coating the cleaned cathode with at least one electrocatalytic coating solution;

(c) drying the coated cathode until it is at least substantially dry; and thereafter (d) contacting the cathode with a solvent redissolving precipitated electrocatalytic salts or acids formed on the cathode, originating from the electrocatalytic coating solution, to form dissolved electrocatalytic metal ions on the cathode, so that said electrocatalytic metal ions can precipitate as metals on the cathode.

2. A method as claimed in claim 1, wherein the cathode substrate is selected from the group consisting of nickel, cobalt, copper, iron, steel, alloys thereof and mixtures thereof.

3. A method as claimed in claim 1, wherein the cathode substrate is nickel.

4. A method as claimed in claim 1, wherein the electrocatalytic coating solution comprises a complexing agent.

5. A method as claimed in claim 1, wherein the electrocatalytic coating solution comprises a complexing agent selected from the group consisting of hypophosphorous acid, sulphurous acid, nitrous acid, alcohols, glycerine, acetate, propionate, succinate, hydroxyacetate, α-hydroxypropionate, aminoacetate, ethylenediamine, β-aminopropionate, malonate, pyrophosphate, malate, citrate, ammonium salts, EDTA, and mixtures thereof.

6. A method as claimed in claim 1, wherein the solvent comprises water.

7. A method as claimed in claim 1, wherein the electrocatalytic coating solution contains salts or acids of Pt, Rh, Ru, Pd, Ir, Os, Ag, Au or alloys or mixtures thereof.

8. A method as claimed in claim 1, wherein a used cathode is activated.

9. A method as claimed in claim 1, including the step of rinsing the cathode with a basic solution.

10. A cathode treated with a method for activation which comprises the steps of:

(a) cleaning said cathode by means of an acid;

(b) coating the cleaned cathode with at least one electrocatalytic coating solution;

(c) drying the coated cathode until it is at least substantially dry; and thereafter (d) contacting the cathode with a solvent redissolving precipitated electrocatalytic salts or acids formed on the cathode, originating from the electrocatalytic coating solution, to form dissolved electrocatalytic metal ions on the cathode, so that said electrocatalytic metal ions can precipitate as metals on the cathode.

11. A cathode as claimed in claim 10, having an overpotential lower that an untreated cathode.

12. A cathode as claimed in claim 11, wherein said overpotential is at least 10 mV lower than said untreated cathode.

13. A cathode as claimed in claim 11, wherein said overpotential is 10–30 mV lower than said untreated cathode.

14. A cathode as claimed in claim 11, wherein said overpotential is more than 30 mV lower than said untreated cathode.

* * * * *